United States Patent [19]

Benoit et al.

[11] Patent Number: 4,596,080

[45] Date of Patent: Jun. 24, 1986

[54] ALPINE SKI BOOT

[75] Inventors: Louis Benoit, Frangy; Norbert Kopp, Chavanod; Joseph Morell, Annecy; Bernard Nerrinck, La Balme-de-Sillingy, all of France

[73] Assignee: Salomon S.A., Annecy, France

[21] Appl. No.: 679,076

[22] Filed: Dec. 6, 1984

[30] Foreign Application Priority Data

Dec. 9, 1983 [FR] France ..... 83 20413

[51] Int. Cl.[4] ..... A43B 11/00

[52] U.S. Cl. ..... 36/120; 36/121

[58] Field of Search ..... 36/120, 121

[56] References Cited

U.S. PATENT DOCUMENTS

| | | | |
|---|---|---|---|
| 3,975,838 | 8/1976 | Martin | 36/121 |
| 4,008,532 | 2/1977 | Kilbourn et al. | 36/120 |
| 4,222,184 | 9/1980 | Kastinger | 36/121 |
| 4,499,676 | 2/1985 | Chalmers | 36/120 |
| 4,519,149 | 5/1985 | Pozzobon | 36/121 |

FOREIGN PATENT DOCUMENTS

| | | |
|---|---|---|
| 2275166 | 1/1976 | France . |
| 2536254 | 5/1984 | France . |
| 57-086301 | 5/1982 | Japan . |

OTHER PUBLICATIONS

Lowa Catalogue exerpt from Lowa's 1983–1984.

*Primary Examiner*—Louis K. Rimrodt

*Attorney, Agent, or Firm*—Sandler & Greenblum

[57] ABSTRACT

A rear-entry ski boot including a rigid shell base and an upper. The upper includes a cuff and a spoiler adapted to pivot between opened and closed positions. Also provided is means for automatically closing the spoiler after the leg is inserted into the boot, in response to pressure from the leg on the boot. The automatic closure means includes a flexible linkage element connected at an attachment point to the cuff, a guide element mounted on the upper and around which at least a portion of the linkage element is wound, a traction element journalled on the spoiler around a journal axis and which is connected to the linkage element, and an elastic apparatus for permanently maintaining a traction force on the linkage element for all positions of the spoiler with respect to the cuff. These elements form a self-latching elbow system which defines a dead point when the guide element, the journal axis and the attachment point are aligned. The spoiler may be substantially freely journalled when the traction element is positioned ahead of the dead point, and the spoiler cannot be substantially freely journalled to the open position when the traction element is positioned behind the dead point, thereby permitting latching of the spoiler and preventing accidental opening of the spoiler during skiing.

51 Claims, 12 Drawing Figures

ALPINE SKI BOOT

BACKGROUND OF THE INVENTION

1. Field of the Invention

The present invention relates to alpine ski shoes or boots, and to other types of shoes, such as certain types of ice hockey shoes. More particularly the present invention relates to shoes or boots of the type in which the foot is inserted into the shoe or boot from the rear and which allow for insertion of the foot and closure in a manner which is at least partially automatic.

2. Description of Background Information

Ski boots presently on the market are the product of years of research into facilitating insertion and removal of the foot into the shoe or boot while at the same time preserving the ease of manipulation of the boot during closure and opening, and maintaining the effectiveness of the boot during skiing. As a result of this research, shoelaces were slowly replac ed by buckle closures. At first, a plurality of buckles (generally four or five) were distributed along the length of the top of the boot. With the evolution of the closure technology and shoe concepts, the number of buckle closures slowly diminished so that only a single buckle closure was used. This occurred because the use of a single closure was particularly well adapted to shoes of the rear entry type. As a result, numerous boots having such a single closure element appeared on the present market, such as that described in French Pat. No. 2,275,166 for example.

However, these single closures have a serious of disadvantage. Individual closures are adapted to surround the perimeter of the lower leg of the skier, but require additional hand manipulation by the skier to obtain closure of the boot. Although the manipulation of a single tightening and closure apparatus requires less effort than other types of closure apparatus, single closures still require a considerable manual effort by the skier, which can be difficult, particularly for women and children who cannot manipulate this type of closure as easily as might be desired. As a result, certain manufacturers attempted to further improve the closure/opening function of ski boots to render them more confortable to use.

These improvements, which have been made essentially to rear entry tape ski boots having a rear spoiler adapted to pivot toward and away from a front cuff, all include a single double action closure and tightening lever, journalled on the rear spoiler. The double action closure and tightening lever cooperates with one end of two cables which are connected at their other end to a portion of the front cuff. A tightening force exerted on the double action lever causes traction of the two cables, which thus brings together the rear spoiler and the front portion or cuff of the upper. In addition traction experienced by the two cables also tightens the boot on the lower leg when the double action lever is completely pivoted beyond the dead point of an elbow joint formed, respectively, by a return corner positioned on the rear spoiler, the journal axis of the double lever and the point (or the points) of attachment of the cables on the lever.

There are a variety of such boots that are manufactured, each using a different type of the double action lever. According to one type of boot, the lever comprises a double-armed rocking lever or balance arm whose journal axis is positioned 2/10 of the length of the balance arm from one end thereof, while the two cables are hooked, respectively, at each of the ends of the arms of the lever. When the skier wishes to close and tighten the boot, he exerts a downward force on the longest arm of the lever, which serves to simultaneously apply a downward traction on an upper cable and an upward traction on a lower cable. As a result, the rear movable portion of the front movable portion of the upper and the journalled rear spoiler are brought together. Such a boot is an improvement to the extent that it requires only a single closure and tightening manipulation of the boot by the skier. However, this boot requires the use of complicated cable circuits, and requires the skier to apply a strong closure force which is entirely beyond the ability of children and women.

According to another type of boot, the double lever comprises a first lever journalled directly on the rear spoiler and a second lever journalled at the median portion of the first lever. The two linkage cables are then hooked to the second lever at two points slightly spaced from one another, such that the difference of the cable lengths placed at different levels on the upper can be absorbed during the closure. In this type of boot, as in the other type of boot, the complexity of the construction detracts considerably from the attempted improvement of having only a single closure manipulation because it results in a very elevated cost of manufacture.

Thus, there is a need for a rear-entry boot that opens and closes automatically without the necessity of any strenuous manual manipulation by the user, and which is constructed simply and is inexpensive to manufacture.

SUMMARY OF THE INVENTION

It is an object of the present invention to provide a boot that can be used for skiing or other sports that is provided with a closure and tightening system in which manual intervention is entirely eliminated, or at least partially suppressed, or which requires an effort which can be exerted by the user's "pinkie", and which is inexpensive to manufacture.

The present invention that achieves these objectives is directed to a rear-entry type ski boot. The boot comprises a ridged shell base and an upper. The upper, in turn, comprises at least two portions, at least one of which is journalled for the opening and closing of the boot around the foot. Also, provided is means for latching the two portions with respect to each other. The latching means comprises at least one linkage element connected at an attachment point to one of the two portions of the upper, and a traction element provided on the other of the two portions of the upper. This traction element is connected to the linkage element. Further, the traction element comprises means for maintaining a traction force on the at least one linkage element for all relative positions of the two portions of the upper with respect to each other. In addition, traction element can be journalled on one of the two portions of the upper around a journal axis.

The at least one linkage element comprises two ends, one of which is connected to one of the two portions of the upper, and the other end which is connected to the traction element. The at least one linkage element is constantly stretched between its two ends by the means for maintaining the traction force.

The latching means further comprises at least one guide element mounted on the upper and on which at least a portion of the at least one linkage element is at least partially wound. The latching means further comprises an elastic apparatus for biasing the traction element so as to maintain a traction force on the at least one linkage element and to constantly stretch the at least one linkage element for all relative positions of the two portions of the upper with respect to each other. The latching means may further comprise means for latching the journalled portion of the upper in a closed position for skiing. Also, the boot may be further provided with the means for adjusting the position of the attachment point of the at least one linkage element to one of the two portions of the upper. Furthermore, the at least one guide element may be positioned above the journal axis and above the attachment point, and the at least one linkage element may be flexible.

In another embodiment, at least one of the two portions is journalled on a rigid shell base and said latching means comprises means for latching and closing of the two portions of the upper relative to one another.

In still another embodiment, one of the two portions of the upper comprises a front portion of the upper and the other of the two portions comprises a rear portion of the upper. The front portion comprises a flexional cuff and the rear portion comprises a rear spoiler. This rear spoiler is journalled on the shell base at substantially at the level of the ankle of the skier. Furthermore, in this embodiment, the latching means comprises means for latching and closing of the rear spoiler on the cuff. Also, the at least one linkage element comprises a cable having two ends, each of which are connected to opposite sides of the cuff at an attachment point. Furthermore, the boot further includes two guide elements and the cable forms a flexible buckle having two ends, each of which wind at least partially on one of the guide elements. These guide elements are positioned on opposite sides of the spoiler and at one end of the spoiler. Also, the buckle is connected to the traction element, the traction element is mounted on the rear spoiler, and the elastic apparatus is mounted between the rear spoiler and the traction element.

In still another embodiment, one of the two portions of the upper comprises a front portion comprising a cuff journalled on the shell base and adapted to undergo forward flexion around an axis substantially at the level of the ankle, and the other of the two portions of the upper comprises a rear portion comprising a spoiler which is journalled on the cuff. In this embodiment, the latching means comprises means for latching and closure of the rear spoiler on the cuff. Also, in this embodiment, the at least one linkage element comprises a cable having two ends each of which are connected to opposite sides of the cuff at an attachment point. The boot further comprises two guide elements and the cable forms a flexible buckle having two ends, each of which wind at least partially on a guide positioned on each side of the rear spoiler. The buckle is connected to the traction element, the traction element is mounted and journalled on the rear spoiler, and the elastic apparatus is mounted between the rear spoiler and traction element.

In still another embodiment, the two portions of the upper comprise respectively, a front portion and a rear portion. The front portion comprises a flexional cuff journalled on a rigid shell base and the rear portion comprises a rear spoiler journalled separately from the cuff on the shell base substantially at the level of the ankle. In this embodiment, the latching means comprises means for latching and closure of the rear spoiler on the cuff and the linkage means comprises a cable having two ends, each of which are connected to opposite sides of the cuff at an attachment point. Furthermore, the boot in this embodiment comprises two guide elements positioned on each side of the rear spoiler. Also, the cable forms a flexible buckle having two portions each wound at least partially on a different guide element. Also, the buckle is connected to the traction element, and the traction element is journalled on the rear spoiler and the elastic apparatus is mounted between the rear spoiler and the traction element.

The boot is designed to secure a skier's foot therein. To this end, the journalled portion of the upper is adapted to adapted to move between opened and closed positions. In one embodiment, the boot further comprises means for receiving the foot when the journalled portion of the upper is in the closed position. In this embodiment, the journalled portion is adapted to be substantially freely journalled with respect to the other portion of the upper from the closed to the opened position when the traction element occupies a threshold position ahead of a dead point of a self-latching elbow system formed by the alignment of the guide element, the journal axis of the traction element, and with the attachment point.

In this embodiment, during the displacement of the journalled portion of the upper from the opened to the closed position, the traction element is displaced from a first position toward the dead point to an intermediate threshold position for which the journalled portion of the upper is in its closed position, but in which the journalled portion is substantially freely pivotable with respect to the other portion of the upper. This intermediate threshold position is ahead of the dead point of the self-latching elbow system formed by the alignment of the at least one guide element with the journal axis of the traction element, and of the attachment point of the linkage element on the traction element.

In addition, in this embodiment, the journalled portion of the upper is adapted to move from its closed position to a self-latching closed position on the other portion of the upper in which this journalled portion is latched tightly on the other portion of the upper, and on the leg of the skier. In this self-latching closed position, the traction element occupies the position which is bent back against the rear spoiler and the attachment point is the ahead of the dead point of the self-latching elbow system.

The boot may further comprise an identification means provided between the traction means and the journalled portion of the upper for identifying this threshold position. In addition, the traction element can further comprise a cap having a depression thereon, and the journalled portion can further comprise a projection adapted to engage this depression. The depression and the projection together comprise a ratchet for releasably holding a traction element at the threshold position. Also, the elastic apparatus can comprise means for automatically pivoting the traction element to a self-latching closed position against the journalled element in response to the displacement of the traction element beyond the threshold position, thereby displacing the journalled portion of the upper to a self-latching position latched tightly to the other portion of the upper.

In still another embodiment, the journalled portion of the upper is adapted to move between open and closed positions, and the boot further comprises means for immobilizing the journalled portion in the open position toward to the rear. In this embodiment, the boot is designed as a means for permitting insertion of the foot when the journalled portion is in its opened position. In this embodiment, the traction element occupies a position in which traction element extends away from the journalled portion when the journalled portion is in the open position. In addition, traction element comprises means for freeing a length of the at least one linkage element which is equal to the amplitude of the bending of the journalled portion of the upper. In addition, in this embodiment, the other portion of the upper is adapted to pivot forwardly. The boot also comprises, in this embodiment, means for neutralizing the immobilization means and automatically pivoting the journalled portion from the opened position to the closed position in response to this forward pivoting of the other portion of the upper. Also, the boot further comprises elastic means mounted between the two portions of the upper for biasing the journalled portion toward the other portion of the upper. Finally, in this embodiment, the journalled portion is adapted to placed in a latched position, latched to the other portion, and the automatic pivoting means further comprises means for pivoting the journalled portion into this latched position from the closed position.

In still another embodiment, the elastic apparatus is directly connected to the traction element, thereby permanently exerting a return moment directly on the traction element. Alternatively, the boot can further comprise an additional element connected to the traction element so that the elastic apparatus exerts a permanent return force on this additional element so as to exert the return force indirectly on the traction element.

In still another embodiment, the elastic apparatus comprises at least one torsion spring having a plurality of spirals positioned coaxially with the journal axis. The torsion spring can comprise two arms, one of which is supported on the traction element, and the other of which is on the journalled portion of the upper. These arms of the spring may be orthogonal with respect to each other. One of the orthogonal arms can be coaxial with the journal axis, while the other orthogonal arm is perpendicular to the journal axis and forms an angle $\alpha$ with the support surface on the journalled portion which is equal to the bending angle of the traction element as the traction element is displaced from a threshold position at which the at least one guide means, the attachment point, and the journal axis are aligned, to a self-latching closed position, in which the longitudinal axis of the traction element is substantially parallel to the rear wall of the journalled portion of the upper.

In still another embodiment, the boot may further comprise a connecting rod having two ends, wherein one end is journalled on the traction element. In this embodiment, the elastic apparatus comprises a spiral compression spring acting on the other end of the connecting rod.

Alternatively, the elastic apparatus can comprise a compression spring acting on a flattened portion provided on the end of the traction element which is journalled on the journalled portion of the upper.

In still another embodiment, the elastic apparatus can comprise a torsion bar mounted at the same vertical level as the journal axis of the traction element on the journalled portion of the upper.

In still another embodiment, the boot can further comprise a plurality of guide elements positioned in the upper zone of the journalled portion of the upper above the journal axis of the traction element. These guide elements can comprise elements bending the linkage element at an angle. Furthermore, the guide elements comprise a grooved passage on the journalled portion of the upper. Alternatively, these guide elements can comprise rigid conduit guides integrated with the walls of the journalled portion of the upper. The at least one linkage element passes through this plurality of guide elements which can be disposed on each side of the rear spoiler.

In still another embodiment, the traction element is journalled so as to perform rotation from the top to the bottom of the journalled portion as the journalled portion moves from an opened to a latched position, latched to the other portion of the upper. Alternatively, the traction element can be journalled so as to perform a rotation from the bottom to the top of the journalled portion as the journalled portion moves from an opened to a latched position latched to the other portion of the upper.

The traction element may also comprise a journalled lever comprising adjustment means for adjusting the position of the point of attachment of the at least one linkage element. Finally, the journal axis may be positioned transversely to the longitudinal median axis of the boot, and horizontally with respect to the plane of the sole of the boot.

In still another embodiment, the invention is directed to a rear-entry ski boot for holding the leg of the skier therein. The boot comprises a rigid shell base, and an upper. The upper comprises a cuff and a spoiler adapted to pivot between opened and closed positions. Also provided is means for closing the spoiler after the leg is inserted into the boot, in response to insertion of the leg into the boot. The closing means may comprise means for closing the spoiler in response to rearward pivoting of the spoiler. Furthermore, this means for closing the spoiler in response to rearward pivoting of the spoiler comprises means for pivoting the spoiler into the open position from the closed position, in response to initial rearward pivoting of the spoiler from the closed position, and means for automatically pivoting the spoiler into the closed position from the open position, in response to pivoting of the spoiler from the closed to the opened position.

In one embodiment, the spoiler is adapted to be latched on the cuff in a latched position spaced from the closed position. In this embodiment, the boot further comprises means for latching the spoiler on the cuff. This latching means comprises an element on the spoiler, adapted to be displaced, and means for automatically pivoting the spoiler to the latched position from the closed position in response to the displacement of the element. In addition, the means for automatically pivoting the spoiler to the latched position comprises means for automatically pivoting the spoiler to the latched position from the closed position in response to the displacement of the element by a finger of the skier.

In an alternative embodiment, the closing means comprises means for closing the spoiler in response to forward flexion of the cuff. In this embodiment the boot further comprises elastic means for biasing the spoiler toward the cuff, and means for retaining the spoiler in the open position and for releasing the spoiler retained in the open position in response to forward flexion of the cuff.

Furthermore, the means for automatically pivoting the spoiler into the open and closed position and the closing means in the alternative embodiment discussed above comprises at least one flexible linkage element, at least one guide element, a traction element, and an elastic apparatus. The at least one flexible linkage element has first and second ends. The first end is connected to one of the spoiler and the cuff. The at least one guide element is mounted on the upper and at least a portion of the linkage element is at least partially wound on this at least one guide element. The traction element is journalled on the other of the spoiler and the cuff, and the traction element is connected to the second end of the at least one linkage element. The elastic apparatus biases the traction element so that the traction element comprises means for permanently maintaining a traction force on the at least one linkage element so as to constantly stretch the at least one linkage element between its two ends for all positions of the spoiler with respect to the cuff.

The traction element can be journalled on an axis and the latching means can comprise the linkage element, the guide means, the traction element, and the elastic apparatus. The alignment of the journal axis with the point of the connection between the second end and the traction element, and with the guide element, defines a threshold position for the traction element. The spoiler automatically pivots to its latched position from its closed position in response to positioning of the traction element ahead of the threshold position.

BRIEF DESCRIPTION OF THE DRAWINGS

The principal characteristic of this new type of boot are described in the following detailed description of preferred embodiments and are illustrated in the attached drawings in which.

DETAILED DESCRIPTION OF PREFERRED EMBODIMENTS

Figure 1:
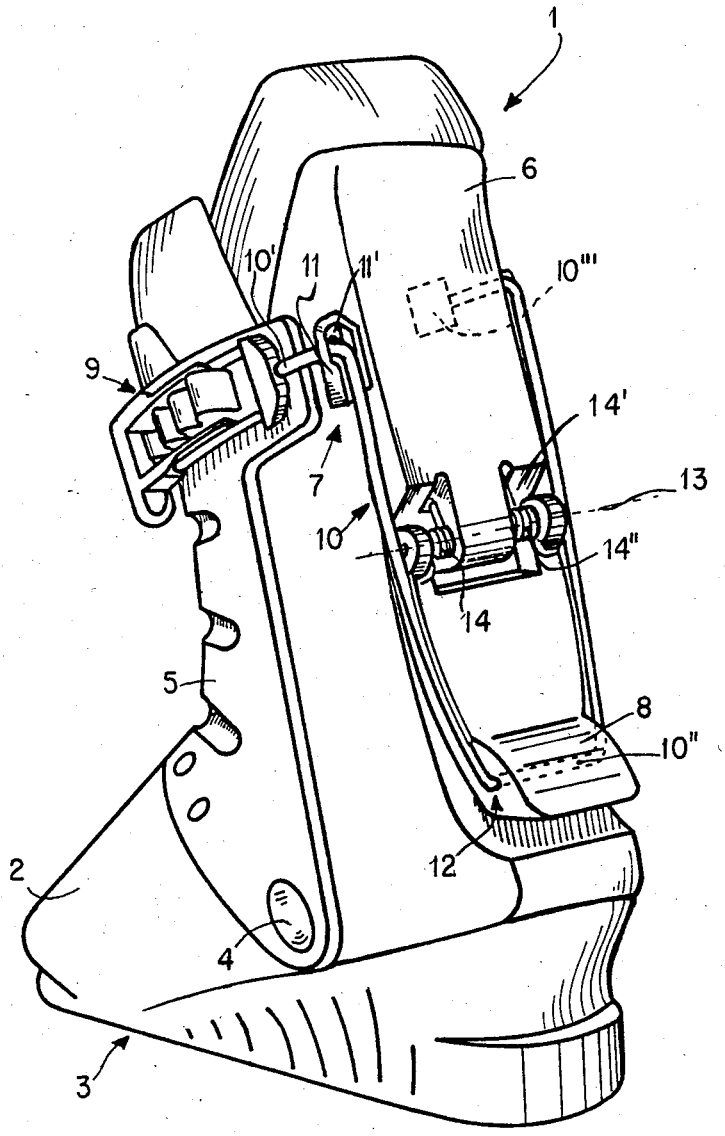
FIG. 1 illustrates a perspective view of a boot according to the invention, provided with an automatic closure and latching apparatus for the upper.

The invention relates to a rear entry-type ski boot comprising a rigid shell base and an upper. The upper comprises at least two portions of which at least one is journalled on the shell base. The upper also comprises latching and closure means for latching and closing the two portions of the upper onto one another. The latching and closure means comprises at least one flexible linkage element connected at one of its ends at an attachment point to one of the portions of the upper. The position of this attachment point is adjustable. Also provided is at least one pulley element mounted on the upper on which the linkage element is at least partially wound. The other end of the linkage element is connected to a traction element provided on the other portion of the upper. The traction element is journalled on one of the two portions of the upper against the force of an elastic return apparatus exerting a permanent return moment on the traction element, so as to constantly tension the linkage element between its two ends, regardless of the positions of the two portions of the upper with respect to each other.

Such a boot has the characteristic described above and thus overcomes the disadvantages of previous boots. By virtue of the traction element which is biased with respect to the upper of the boot, it is possible to put on the ski boot of the present invention and to ensure the closure and tightening of the upper on the base of the leg of the skier without the necessity of the skier using any force himself.

However, although such an integrated closure apparatus permits for automatic closing and tightening the boot when the foot is inserted therein, the boot can only be opened by manual manipulation of the skier (e.g., it requires opening with the pole, by hand, or the foot). As a result, the liberation of the foot from the boot can only result from voluntary action on the part of the skier, thereby guaranteeing that the boot will not be opened accidentally, which is undesireable for safety reasons.

Thus, in all cases, the traction element will assume at least two positions, one automatically closed, the other open, and, for which it frees a length of the linkage element sufficient to allow for a separation of the two portions of the upper so as to permit the introduction of the foot into the boot. In certain embodiments, the traction element can assume a third intermediate, or pre-closed position, beyond which the skier will complete the closure movement of the traction element on the upper, while the majority of the closure and latching forces will have been furnished by the return moment of the elastic apparatus.

According to the general design of this invention, the ski boot comprises in each embodiment a linkage element linking the two portions of the upper by means an adjustable attachment means on one of the portions of the upper, and a return or redirecting element positioned on the other portion of the upper. The return or redirecting element redirects the traction force exerted by the traction element on the linkage element from a first direction to a second direction in the direction in which the spoiler moves toward the cuff. The direction along which the traction force is redirected is adjustable. The linkage element, under the action of the elastic return apparatus of the traction element, thus remains constantly subjected to a tension and is permanently stretched, regardless of the relative position of the two portions of the upper relative to each other.

There exist several embodiments which embody the general design of the invention. One embodiment is used for boots requiring, for example, the upper to be in an initial open position in which the journalled portion is in the open position before insertion of the foot. Another embodiment can be designed for a boot in which it is desirable for the initial position of the two portions of the upper to be closed on one another so that one portion overlaps or bends over the other portion, but the two portions are not latched to one another. When the foot is be introduced into such a boot, the foot and leg themselves space the two upper portions relative to one another.

In the latter case, the boot according to the invention, is of the rear-entry type, and comprises two portions: a rigid shell base integral with a front portion of the upper, and a rear spoiler comprising a rear portion of the upper which is journalled on the rigid shell base substantially at the level of the ankle. According to this embodiment, the boot opens by the pivoting of the rear spoiler to the rear during introduction of the foot. In effect, the linkage element is connected at one of its ends to the upper zone of the front portion of the upper and extends at least partially along the upper periphery of the lower leg to wind around a return corner or redirecting element provided on each side of the rear spoiler, and is then hooked by a buckle to a traction element journalled on the rear of the rear spoiler.

Preferably, the journal axis of the journalled traction element will be positioned lower on the rear spoiler than the position of the return or redirecting elements. The relative position of the journal axis and the return or redirecting elements controls or influences the extent of movement of the rear spoiler during opening.

The traction element is subjected to the force of an elastic apparatus which biases it back permanently towards its bent back position on the rear spoiler. The traction element which is thus biased, in turn subjects the linkage element to a permanent tension which requires the rear spoiler to always return to occupy a closed position closed over on the front portion of the upper.

The placing of the foot in the boot is characterized by several different phases in which the rear spoiler occupies several different positions with respect to the cuff, and the traction element occupies several different positions with respect to the rear spoiler. During the first phase the rear spoiler pivots rearwardly, and the pivoted traction element moves from its downwardly bent over position to an upwardly raised position on the rear spoiler. This first phase is immediately followed by a closure phase in which the rear spoiler closes on the cuff by performing a frontward retraction due to the permanent tension of the cable, described above. During this retraction of the spoiler, the traction element under the effect of the elastic return apparatus to which it is attached, moves from its upper raised position to a retracted position which is a pre-closed position. This pre-closed position corresponds to a position in which the rear spoiler is not latched onto the lower leg of the skier. The pre-closed position comprises a threshold ahead of which it is always possible to substantially freely pivot the rear spoiler from the open to the closed of the boot and vice versa, and beyond which, the traction element achieves the final auto-latched closure position of the boot in the cooperation with the tensioned linkage element and the elbow system. Preferably, the preclosed position can be marked by the positioning of a cam or retractable abutment on the traction element or the rear spoiler which defines the threshold position.

According to another embodiment which also embodies the general concept of the invention, the boot is of the rear-entry type such as previously described and, according to an invention previously developed by Applicants, is characterized in that the rear spoiler moves from the open position to the closed utilization position on the leg of the skier in response to a frontward flexional force of the leg exerted on the frontward portion of the upper. This is accomplished by a relay means for relaying the flexional force to a retention means. This force frees the retention means from its blocked position. In its blocked position the retention means maintains the rear spoiler in the open position against the bias effect of an elastic apparatus.

This boot is also equipped with a latching apparatus which, according to the invention, additionally comprises the automatic closure system described above.

Contrary to the first embodiment described above, in this second embodiment the initial position of the boot is the open position in which the two portions of the upper are spaced apart to permit insertion of the foot into the boot. During the introduction of the foot into the boot, the two portions of the upper are spaced from one another, and under the effect of a flexional movement of the leg of the skier, a liberation of the rear spoiler results which recloses on the leg of the skier. This flexion causes the closing of the upper on the leg, and simultaneous pivoting of the traction element towards the bottom of the rear spoiler. Because the stable equilibrium (which had previously been achieved by the latching of the rear spoiler in the open position) has been disrupted, the traction element which is now positioned in a raised position and maintained by the traction of the linkage element, is freed so that it is only subjected to the force of the elastic return apparatus. The return moment exerted by the elastic return apparatus on the traction element thus makes it possible to maintain the tension in the linkage element during the entire closure phase of the rear spoiler on the front of the upper. Preferably the elastic apparatus is adapted to allow the elbow system comprising a journalled element and the linkage element to move from the threshold position to the final self-latching position of the apparatus without any manual manipulation by the skier.

According to other possible embodiments, the general concept of the invention can be applied to ski boots of the rear-entry type whose journalled upper comprises a front portion journalled on the shell base, and a rear spoiler journalled on the rear portion of the upper.

Finally, according to another embodiment of the present invention, the front portion of the upper and rear spoiler are each journalled separately on the shell base, either by interposition of two individual seperate axes or on a common axis whose designs, which are known, have not been illustrated for reasons of simplicity.

A first embodiment of the boot is illustrated in FIG. 1. The boot 1 in this embodiment comprises, in a conventional manner a rigid shell base 2 with a sole 3 and an upper journalled around a transverse horizontal axis on base 2. The upper comprises a front portion 5 and a rear portion 6. The front portion 5 is hereinafter designated as a cuff while the rear portion 6 is designated as a rear spoiler which is consistent with the use of these terms normally adopted in alpine skiing boots. According to the technical field of the invention, it is sufficient that only the rear spoiler 6 be effectively journalled on base 2 in order to allow for its pivoting towards the rear in a manner so as to permit the easy introduction of the foot of the skier into the boot (i.e., rear insertion). Furthermore, the upper is equipped at its upper portion, corresponding to the bottom of the leg of the skier, with a latching apparatus 7 which ensures the maintenance of the closure of the rear spoiler 6 on cuff 5 on the leg of the skier.

Figure 2:
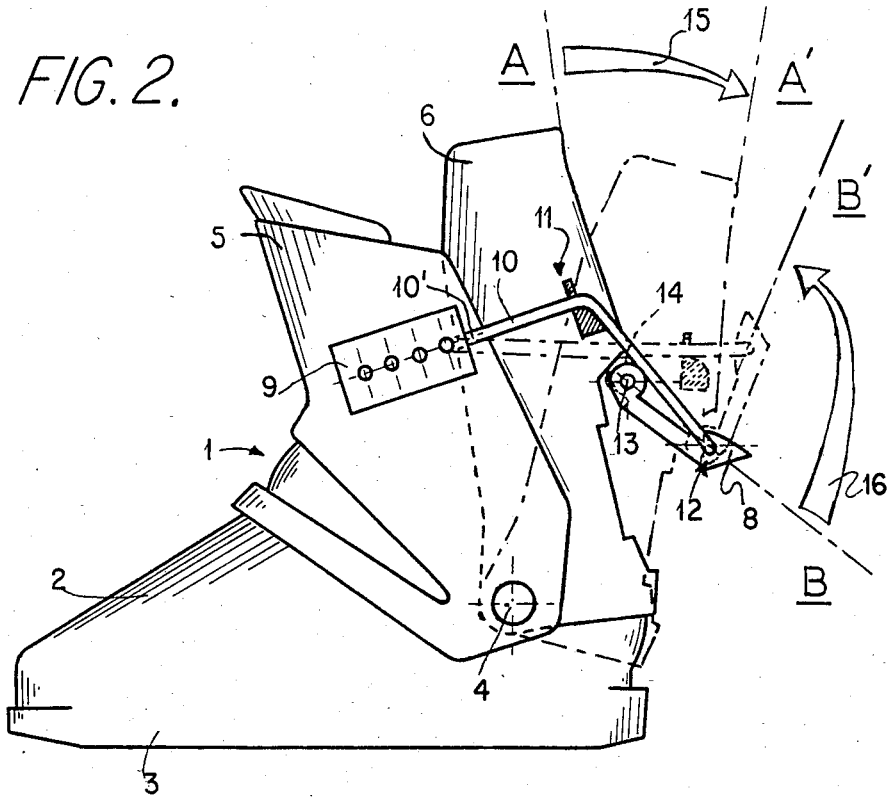
FIG. 2 illustrates a schematic side view of the boot of FIG. 1 in the course of its different phases of insertion of the foot into the boot.
Figure 3:
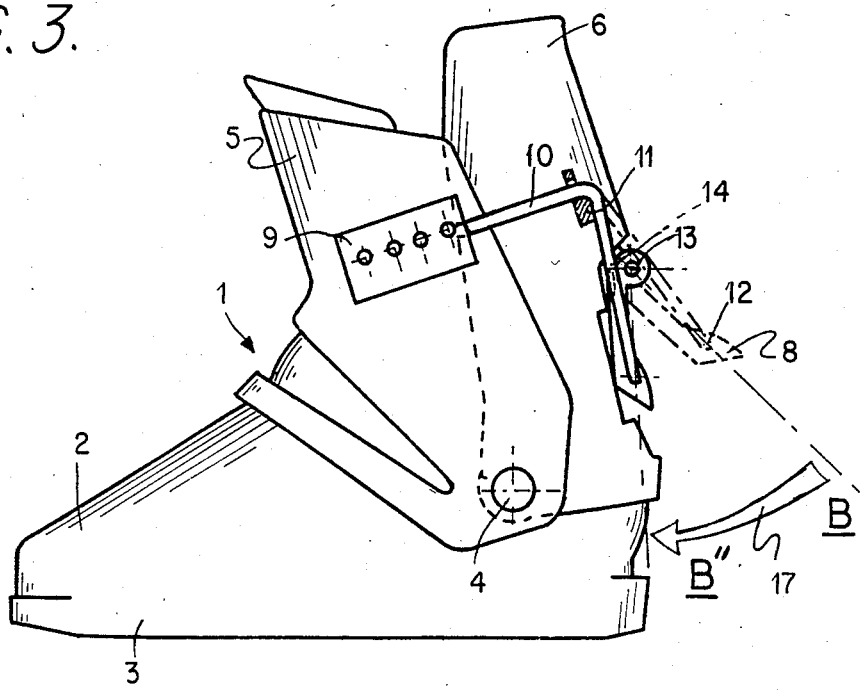
FIG. 3 illustrates a schematic side view of the final phase of the insertion of the foot into the boot seen in FIG. 1 for which the apparatus, according to the invention, is in the automatically closed position.

In the embodiment illustrated in FIGS. 1–3, latching and closure apparatus 7 extends rearwardly along the upper to a traction element comprising a manipulation lever 8 journalled on the rear spoiler. This closure and latching apparatus comprises a hook closure apparatus 9 mounted on one of the lateral sides of the upper portion of cuff 5. The rear end of hook closure apparatus 9 is connected to one of the ends 10' of a linkage element, such as cable 10. Cable 10 extends rearwardly along the periphery of the upper portion of the upper across a sort of passage 11' on spoiler 6 whose rear surface is provided with a guide groove 11 acting to guide cable 10 along a downward path. Groove 11 functions to redirect cable 10. When the spoiler moves from its open to its closed position, groove 11 redirects a traction force on one end of cable from a generally upward direction (from lever 8 to guide 11) to a generally forward direction (from guide 11 to lock 9 and cuff 5). This redirection of the traction force on cable 10 causes spoiler 6 to return to its closed position by pivoting forward toward cuff 5. As a result, guide 11 is also called redirection or return means or a return angle. In addition, a plurality of return angles 11 may be provided and they may be in the form of rigid conduit guides or a grooved passages on the walls of the rear spoiler. Cable 10 having changed direction at groove or return angle 11, is then is directed downward to latching means 12 provided on journalled lever 8. The cable thus forms a latching buckle 10''. The other side of latching buckle 10'' extends upward along the other side of the boot and ends at end 10'''. End 10''' is connected to cuff 5 by anchorage means which may be adjustable, to adjust the position of end 10''' and which are in themselves known. Therefore, the position of end 10''' of cable 10 is adjustable by anchorage means, and the position of end 10' of cable 10 is adjustable by hook 9.

According to one of the principal characteristics of the invention, journalled lever 8 is journalled on spoiler 6 at journal axis 13 which is tranverse to the longitudinal median axis of the boot and is horizontal with respect to the plane including the sole of the boot, and lever 8 comprises an elastic apparatus at the lever of journal axis 13. The elastic apparatus comprises, for example, at least one armed torsional spring 14. Spring 14 is positioned such that one of its arms 14' rests against a wall of rear spoiler 6 and the other arm 14'' is supported on the body of lever 8. As a result, spring 14 causes lever 8 to experience a return force which biases lever 8 downwardly against the wall of the rear spoiler.

Each of the ends of cable 10 defines, by virtue of its attachment along the body of the lever, an "L" configuration. In addition each end of cable 10 is stretched by lever 8, by an amount which depends upon the position of the lever. It will be noted that closure and tightening apparaus 7, by virtue of the relative positions of journal axis 13 of the lever, return angle 11, and attachment point 12 of cable 10 on lever 8, comprises an automatic latching elbow system. In such an automatic latching elbow system, there is very small or substantially zero resistance to pivoting spoiler 6 to its opened position (i.e. point A') when lever 8 is positioned ahead of or at a threshold or dead point of the elbow system. However, once lever 8 is positioned beyond its dead point, it takes considerable effort for the skier to open spoiler 6.

FIGS. 2 and 3 illustrate more particularly the operation of one such apparatus of the present embodiment having an automatic latching elbow system which possesses the peculiarity of having an initial insertion position of the foot into the boot in which the upper is closed, but which is not latched. This initial closed position, in which the upper can be substantially freely journalled to the opened position, is obtained by virtue of the fact that the elbow system described above remains ahead of the dead point of the elbow which defines a threshold position as will now be described.

Figure 4A:
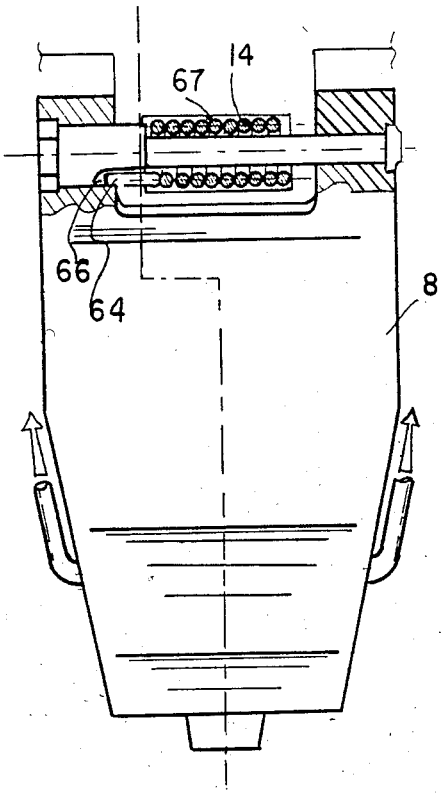
FIGS. 4A and 4B illustrate a side and top view in detail of a traction element comprising a biased journalled lever comprising adjustable cable means.
Figure 4B:
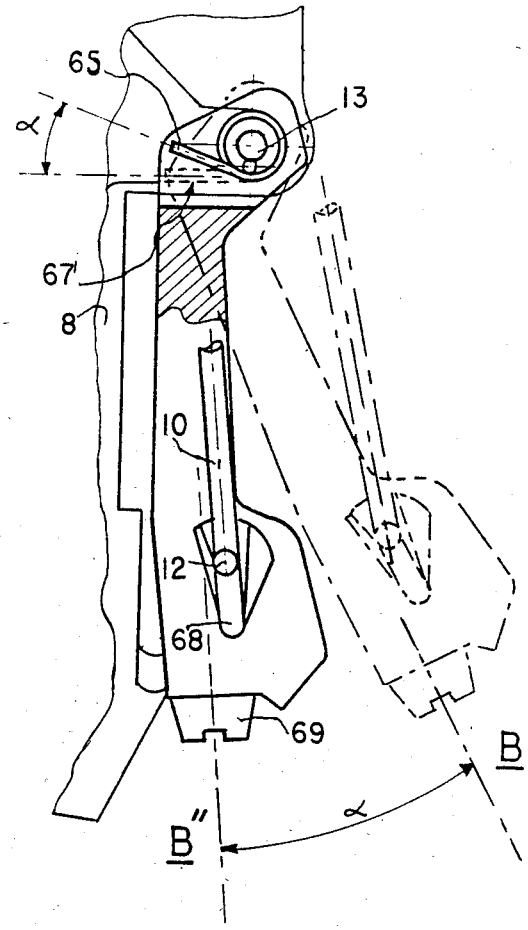

According to one embodiment seen in FIGS. 4A and 4B the return moment exerted by spring 14 on lever 8 is substantially zero for threshold position B. Preferably spring 14 comprises at each of its ends two arms 64 and 65 whicha re orthogonal relative to one another. Arm 64 is parallel to journal axis 13 and is positioned in groove 66 of lever 8 through which journal axis 13 passes. Arm 65 is supported within a housing 67 for the spring provided in rear spoiler 6. Furthermore, arm 65 forms an angle $\alpha$ with the bottom 67' of housing 67 in the final automatically latched position B'' of the closure apparatus. Angle $\alpha$ is equal to the bending angle of traction lever 8 as traction lever 8 is displaced from the dead point B to self-latching closed position B''. In the threshold position B, arm 65 is supported by bottom 67' shown in dashed lines, such that for the threshold position, journalled lever 8 begins to be biased by spring 14. Finally, the position of attachment point 12 of cable 10 on the lever can be adjusted through a range by an adjustment means 68 adapted to be manipulated by a threaded button 69. This adjustment system is not described in greater detail because it is of the screw-nut type which is known in itself.

During the introduction of the foot into the boot, rear spoiler 6 is in a closed position in which it is bent over and overlaps a portion of the front of the upper (i.e., the position shown as A), while lever 8 is positioned ahead of (i.e. above) the threshold position indicated by the letter B as seen in FIGS. 2–4 A and 4B. When the foot of the skier penetrates into the boot, the foot spaces the rear spoiler 6 rearwardly as is indicated by arrow 15, while simultaneously, lever 8 is subjected to the tension of the cable at its end, and as a result, lever 8 is progressively raised upwardly as is schematically shown by arrow 16 until the total opening position of the rear spoiler shown by A' is achieved, thereby permitting the perfect positioning of the foot in the boot. During this time lever 8 reaches position B'. After rear spoiler 6 and lever 8 achieve their totally opened position, respectively A' and B', the frontward bending or pivoting movement of the rear spoiler 6 resumes without any interruption. This frontward pivoting of spoiler 6 occurs because after all force relating to the introduction of the foot has ceased, the rear spoiler is only subjected to a return force exerted by spring 14 on lever 8. As a result, lever 8 is pivoted clockwise away from position B' thereby transmitting a tractional force to cable 10. Because one end 10' of cable 10 is connected to cuff 5, which is fixed with respect to rear spoiler 6, the tractional force on cable 10 returns the rear spoiler frontwardly by virtue of return groove 11 which changes the direction of force transmitted by lever 8. When rear spoiler 6 returns to closed position A on the upper, lever 8 also returns to the pre-closed or threshold position B. Thus, it can be noted that in view of spoiler 6 being ahead of this threshold position, the skier always possesses the ability of effortlessly bend the rear spoiler to the rear, thereby preserving the freedom necessary for walking.

Figure 5:
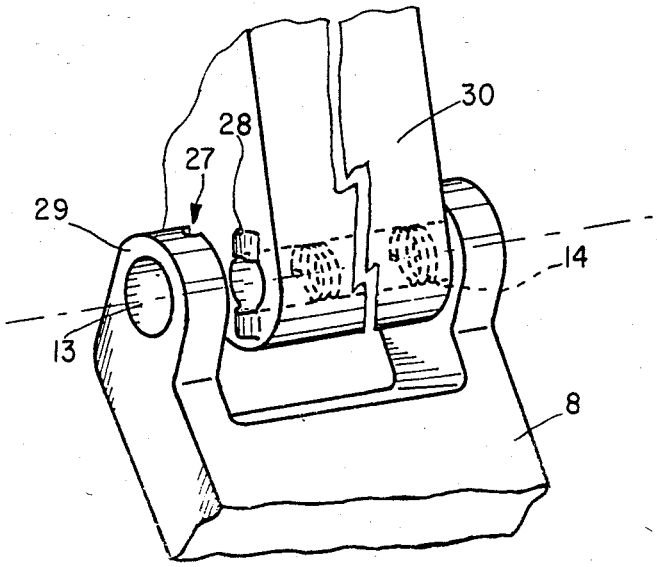
FIG. 5 illustrates a perspective view in detail of an elastic apparatus mounted on the journal axis of a traction element provided by means for defining and localizing the threshold position of the closure.

Once lever 8 has reached threshold position B, defined by the alignment of return angle 11, journal axis 13, and the attachment point 12 of the cable on the lever in a straight line , one can practice skiing, by latching the upper into the closed position on the bottom of the leg of the skier. To achieve this latching, several embodiments can be used. One embodiment comprises mounting a spring (or any other elastic apparatus) on lever 8 whose return force on the lever is such that it ensures the displacement of lever 8 along arrow 17 as seen in FIG. 3 from threshold position B of the lever to the automatically latched and closed position B″. Preferably, the threshold position can be further defined by the cooperation of a ramp 27 on a cap 29 of lever 8 with a ramp 28 on attachment projection 30 of rear spoiler 6 as seen in FIG. 5. It is precised that ramp 27 only engages ramp 28 at threshold position B of the lever 8. Ramps 27 and 28 comprise a type of ratchet connection between lever 8 and spoiler 6 when lever 8 reaches its threshold position which blocks further automatic pivoting of lever 8 beyond threshold B. Lever 8 can be unblocked so as to permit further pivoting to closed position B″ by a small finger pressure of the skier. Once this small amount of pressure is applied by the finger of the skier, lever 8 automatically continues its latching movement (i.e., in the direction of arrow 17) under pressure from spring 14 until position B″ is reached. In this position the attachment point of cable 10 on lever 8 is beyond of the dead point.

According to another embodiment relating to FIG. 4, spring 14 applies a substantially zero force at the threshold position to lever 8. In this embodiment the lever is simply pushed by the skier's hand toward position B″ such that the ratcheting of the ramps is released so that the passage of the cable and lever beyond the dead point constituted by journal axis 13 occurs simultaneously so as to achieve the final automatically latched position of the lever. When this occurs, it will be noted that the latching force exerted on the end of the lever diminishes to become zero adjacent to the threshold position. This constitutes one of the advantages achieved by the invention for facilitating the closure of a ski boot. It should also be noted that the anchorage and adjustable latching of the ends of the buckle and/or cable have been illustrated in a purely conventional manner so as to simplify the drawings.

Figure 6:
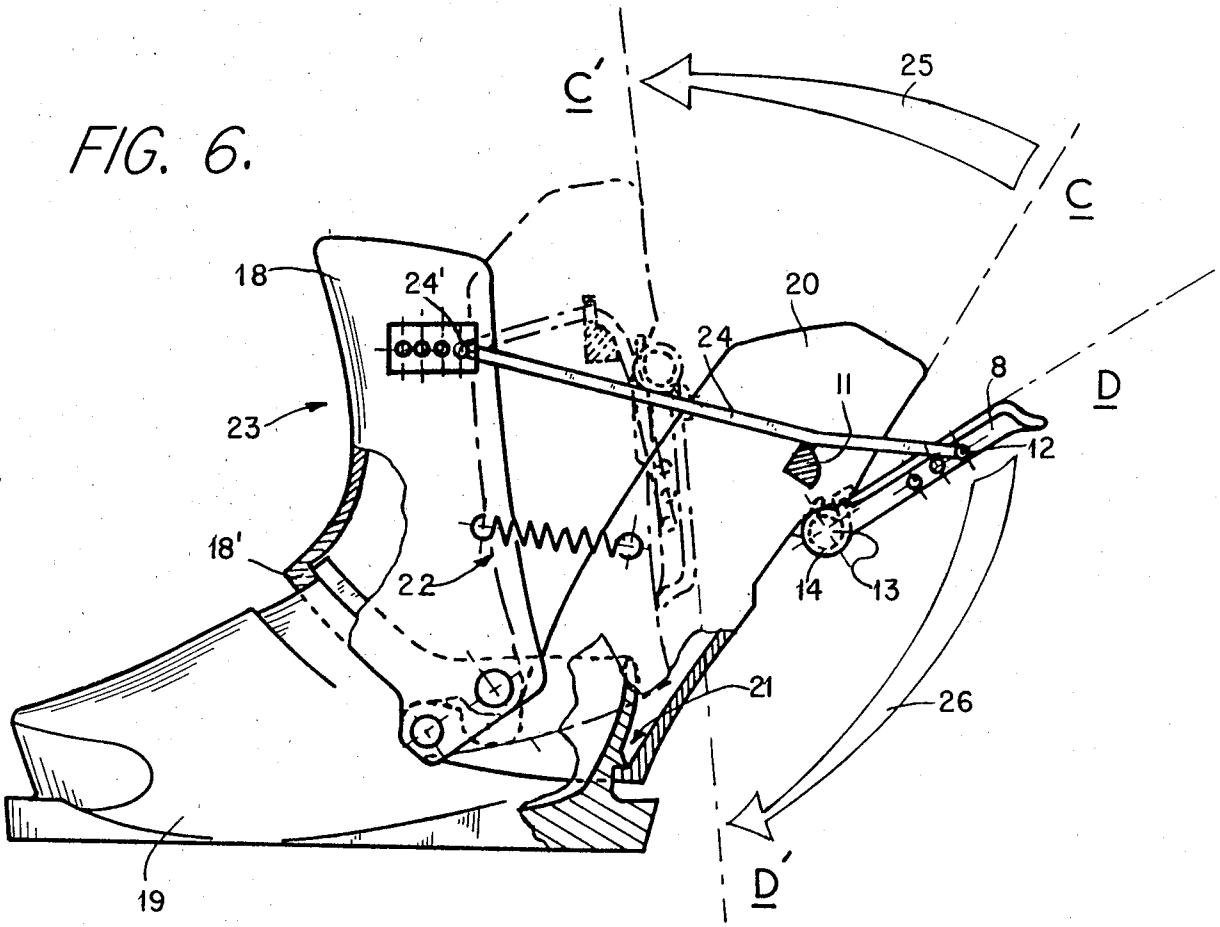
FIG. 6 illustrates a schematic side view of another alternative embodiment of a boot according to the invention whose initial foot insertion position is an open position of the upper.

According to a second embodiment illustrated in FIG. 6, a ski boot 23 of the rear entry type is shown, whose upper comprises a cuff 18 journalled on shell base 19, while rear spoiler 20 is itself journalled on cuff 18. This boot also comprises retention means 21 for retaining rear spoiler 20 in the open position against the force of a first elastic apparatus schematically illustrated by a traction spring 22. Elastic apparatus 22 is positioned, for example, between the cuff and the rear spoiler. Furthermore, according to the specific application of the invention to this type of boot, the upper portion of upper 18 is equipped with a closure and latching apparatus such as was previously described in the case of the preceding embodiment. In the present embodiment, the upper of boot 23 is illustrated in the open position, which corresponds to the initial foot insertion position (indicated by the letter C). Thus, the insertion of the foot into this boot occurs in a perfectly common manner by the natural introduction of the foot of the skier into the boot. In the open position, cable 24 connecting cuff 18 to rear spoiler 20, is stretched over its entire length between its attachment point 24' (or in an alternative embodiment a plurality of attachment points) to the cuff and its attachment point 12 to its latching point 12 on lever 8. In this open position lever 8 is then in the raised position D.

The boot, by virtue of retention means 21 is in a stable open position in FIG. 6. According to the peculiarity of this type of boot, the closure of rear spoiler 20 on the leg is achieved by the exercise of a forward flexional movement of the leg of the skier on the front of the boot which frees rear spoiler 20 from the grip of retention means 21. Spring 22 as a result, acts spontaneously to return spoiler 20 towards cuff 18 (in the direction of arrow 25).

This flexional movement causes, simultaneously with the closure of the rear spoiler, a pivoting of lever 8 towards the bottom of the rear spoiler. This pivoting of lever 8 is controlled by a return spring 14, preferably positioned at the lever of journal axis 13 of the lever on the rear spoiler as was previously described. The force of spring 14 is no longer counteracted by the force furnished by retention means 21 because spoiler 20 is no longer in its stable equilibrium position in which retention means 21 counteracts the bias of spring 14. As a result, rear lever 8 is controlled only by the return force exerted thereon by spring 14. This return force of spring 14, in turn is transmitted to the cable as lever 8 pivots and causes a traction on the cable connected to the lever. Therefore, cable 24 follows the downward pivoting (in the direction of arrow 26 of lever 8) as the rear spoiler bends frontwardly in the direction of arrow 25. This traction on cable 24 is permanently exerted during the pivoting of lever 8. By virtue of the particular construction of cuff 18 which comprises a rear support abutment 18' which renders its fixed with respect to rear spoiler 20, cable 24 returns the rear spoiler frontwardly until spoiler 20 contacts return means 22 which limits the amplitude of forward displacement of spoiler 20.

In the case where the closure amplitude of the rear spoiler is sufficient, the traction on the cable is applied in a permanent manner until the lever reaches the final auto-latched position (position D') corresponding to the closed position (C') of the rear spoiler on the cuff. As in the previous embodiment, one can provide the lever with a threshold or pre-closed position and one can employ the same means to achieve this. The interest in this constructional detail resides in the ability of the skier to comfortable walk in such a boot, but this has not been illustrated in the embodiment shown in FIG. 6, so as to illustrate the actual appearance of a total automation system for insertion of the foot into the boot in this embodiment.

Figure 7:
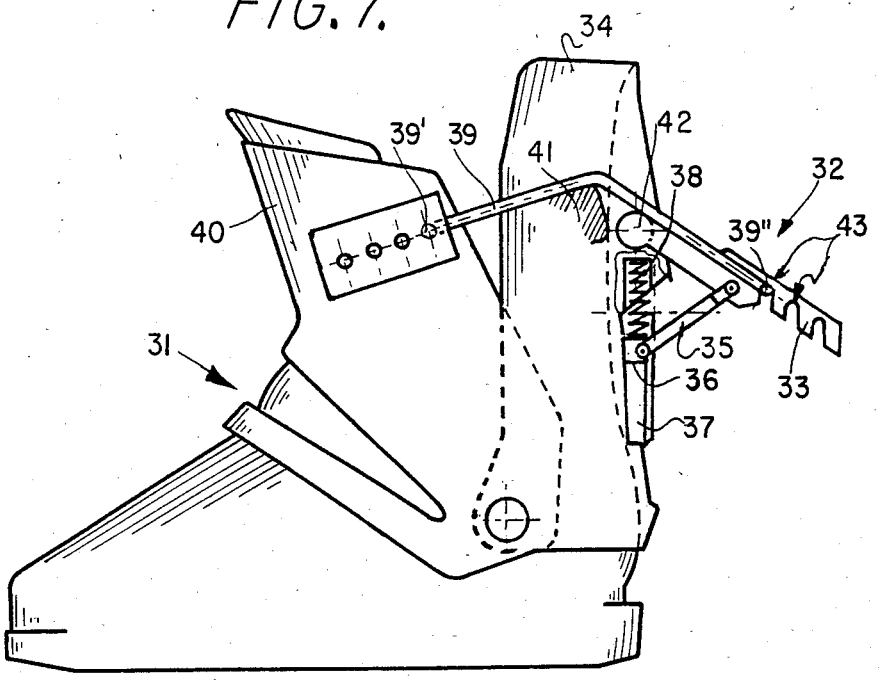
FIG. 7 illustrates a side view of an alternative embodiment of a boot according to the invention having an automated closure and latching apparatus in which the elastic apparatus acts indirectly on the manipulation lever.

According to another embodiment illustrated in FIG. 7, boot 31 comprises a closure and latching apparatus 32 whose structure differs slightly from that which has been previously described. In this embodiment journalled lever 33 which is journalled on rear spoiler 34 is no longer directly biased with respect to the spoiler but is biased indirectly by means of a return connecting rod 35. Connecting rod 35 is journalled at one end at the lever of the median portion of journalled lever 33, and at its other end, on a slide 36 which moves in a vertical guide groove 37 positioned on the rear surface of rear spoiler 34. Slide 36 cooperates with an extension spring 38 which permanently pushes the lower end of connecting rod 35 downwardly. This movement is retransmitted by connecting rod 35 to lever 33 which it causes to bend down towards the bottom of the spoiler. Induced pivoting of the lever causes a traction on cable 39 which is connected at one of its ends 39' to cuff 40, which is fixed with respect to the spoiler. Cable 39 is connected at the other of its ends 39" to lever 33. Consequently, the traction on cable 39 pivots rear spoiler 34 frontwardly by virtue of guide or return angle 41 positioned in the upper zone of the rear spoiler, preferably higher than that of journal axis 42 of lever 33. Return angle 41 changes the direction of the tractional force transmitted by the lever to the direction in which the rear portion of the upper is closed on the cuff. This constructional alternative as in the case of FIG. 1, functions with an initially closed foot insertion position in which the spoiler is closed but not latched to the cuff. In addition, the threshold position of the apparatus is defined by the alignment of return angle 41, journal axis 42 of the lever and the attachment point 43 of the cable on the lever. The closed auto-latched position is achieved after passage through the dead point (journal axis 42) of the self-latching elbow system which comprises the return angle, the lever, the elastic means, and the cable.

Figure 8:
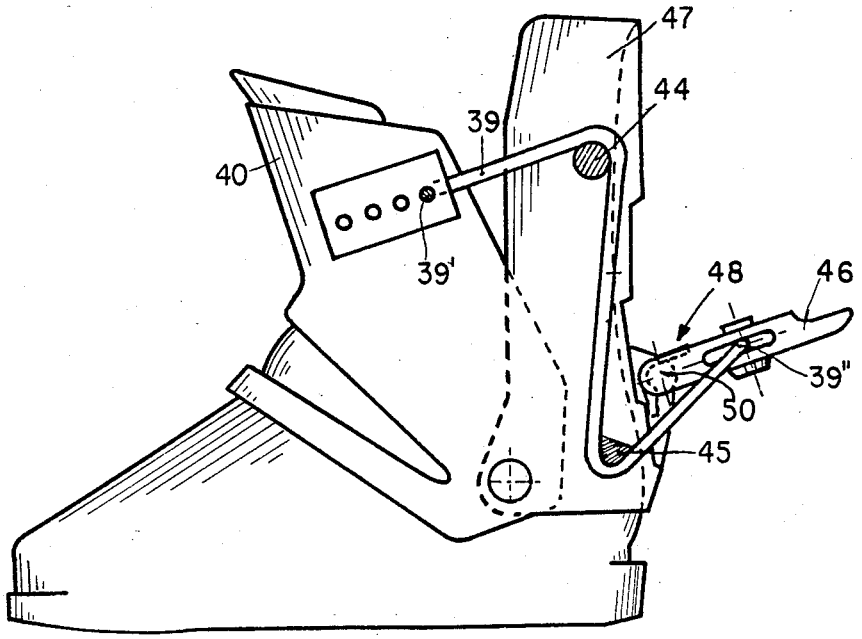
FIG. 8 illustrates a side view of another an embodiment of a boot according to the invention in which the closure and latching apparatus comprises a biased manipulation lever folding back towards the upper portion of the rear portion.

Of course, it is within the scope of the invention to have the traction element of the linkage element comprise a lever 46 journalled at the base of rear spoiler 47 as seen in FIG. 8. In this embodiment, the closure and latching apparatus is provided with a plurality of supplemental return or guide elements 44, 45 such that the automatic closure and latching functions described above still obtain despite the differences in the circuit of the cable along the upper. As in the preceding embodiments, lever 46 is biased with respect to the rear spoiler by the assembly of an elastic and return apparatus, preferably a torsion spring 48 centered on journal axis 50 of lever 46. The advantage of this type of construction is that return angle 44 (comprising a pulley, for example) can be positioned very high and very much to the rear on the upper portion of the rear spoiler thus allowing for a very substantial opening bending of the upper. In this embodiment lever 46 rotates from the bottom to the top of the rear spoiler to close and latch the spoiler on the cuff. This is the opposite of the embodiments seen in FIGS. 1–7 in which the lever rotates from the top to the bottom of the rear spoiler to close and latch the spoiler on the cuff.

In a general manner, the advantages provided by all of the embodiments described above result from the construction of the closure and latching apparatus, because the force necessary to close and latch the boot is reduced greatly and is very weak during the entire closure phase of the upper on the leg. This permits an easy manipulation of the boot by the skier, even when, the latching force reaches a maximum in the closed position. However, in this closed position the force to be applied by the skier on the lever is null due to the elbow system. This authorizes the practice of rear pushing by the skier on the boot because the resistance increases simultaneously with the force transmitted by the skier.

The invention is not limited only to the embodiments described above, and in particular is not limited to the particular elements of the closure and integrated tightening apparatus, such as the traction element, linkage element, elastic return apparatus, and return element. These elements may be of different designs which are known to those of ordinary skill in the art.

Figure 9:
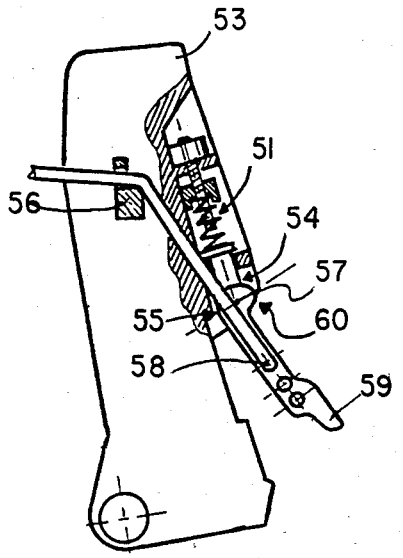
FIGS. 9–11 illustrate side, front, and perspective views, respectively of various bias means of the manipulation lever according to the invention.
Figure 10:
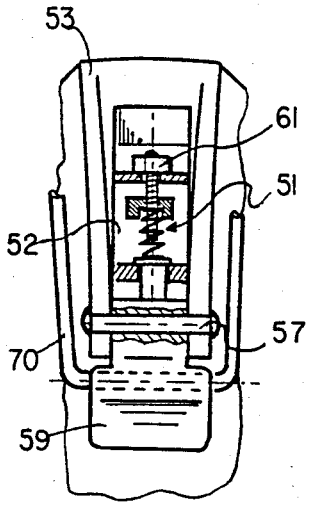
Figure 11:
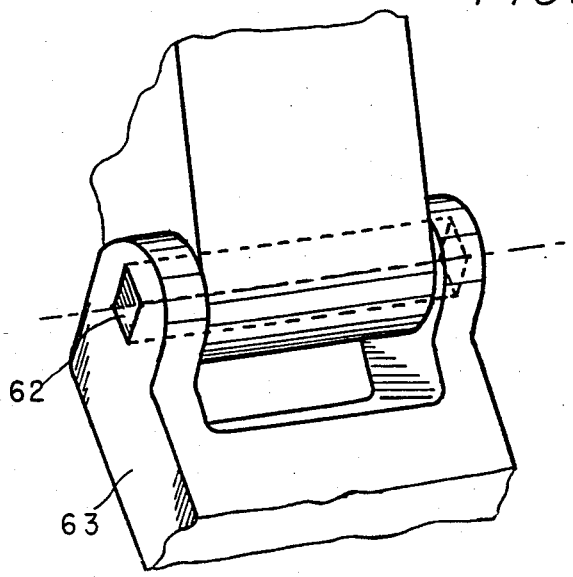

Thus FIGS. 9–11 illustrate various bias means for the journalled manipulation levers on the rear spoiler of a boot according to the invention.

In particular, FIGS. 9 and 10 schematically illustrate in two different views, an adjustable bias system of a journalled manipulation lever. According to a known principle, spring 51, positioned in a housing 52 of rear spoiler 53, presses on a flattened portion 54 of journalled end 55 of the lever. This arrangement always returns the lever downwardly (or in the upward position) if the lever is connected to a cable running along a circuit such as indicated in FIG. 8, in a pre-closed position, just before the dead point of the elbow system formed by return angle 56, the journal axis 57 and the attachment point 58 of cable 70 on lever 59. It will be noted that elastic return of lever 59 is a function of the position, width, and the orientation of flattened portion 54 on end 55 of the lever. As soon as the spring is no longer in contact with the flattened portion, there is no longer any elastic return face (zone 60 of the lever) which permits boot constructions according to the invention, to be provided with partial elastic forces. Furthermore, the intensity of the force of the spring can be adjusted by means of screws 61 to adjust the initial compression of the spring. Of course, the spring is not limited to a spiral spring, but may be preferably replaced by an elastomeric block, a rubber element, etc.

FIG. 11 illustrates another version of the bias means of the lever of a boot according to the invention for which the spring is formed by a torsion bar 62 positioned at the same vertical level as the journal axis of lever 63. The operation remains identical to that previously describe in connection with FIG. 1.

Although the invention has been described with reference to particular means, materials and embodiments, it is to be understood that the invention is not limited to the particulars disclosed and extends to all alternatives, equivalents and combinations for the materials, means and embodiments disclosed within the scope of the claims. As example of such an equivalent is a boot where the traction element and the guiding elements of the cable are provided on the front portion of the cuff instead of the rear spoiler. Because of the obviousness of such a construction within the scope of the invention no drawing has been added to the figures.

What is claimed is:

1. A rear-entry type ski boot comprising:

(a) a rigid shell base;

(b) an upper comprising at least two portions of which at least one is journalled for the opening and closing of the boot around the foot of a skier;

(c) means for latching of said two portions with respect to each other, said latching means comprising:

(i) at least one linkage element connected at an attachment point to one of the two portions of the upper; and (ii) a traction element provided on the other of the two portions of the upper which is connected to the linkage element wherein said traction element comprises means for maintaining a traction force on the at least one linkage element for all relative positions of said two portions of said upper with respect to each other.

2. The boot defined by claim 1 wherein said traction element is journalled on the other of said two portions of said upper around a journal axis.

3. The boot defined by claim 2 wherein said at least one linkage element comprises two ends, one of which is connected to one of said two portions of the upper, and the other end of which is connected to the traction element, wherein said at least one linkage element is constantly stretched between its two ends by said means for maintaining said traction force.

4. The boot defined by claim 3 wherein said latching means further comprises:

(iii) at least one guide element mounted on said upper and on which at least a portion of the at least one linkage element is at least partially wound.

5. The boot defined by claim 4 wherein said latching means further comprises:

(iv) an elastic apparatus for biasing said traction element so as to maintain a traction force on the at least one linkage element and to constantly stretch the at least one linkage element for all relative positions of the two portions of the upper with respect to each other.

6. The boot defined by claim 5 further comprising means for adjusting the position of said attachment point.

7. The boot defined by claim 5 wherein said latching means comprises means for latching the journalled portion of the upper in a closed position for skiing.

8. The boot defined by claim 5 wherein said at least one guide element is positioned above said journal axis and above said attachment point.

9. The boot defined by claim 5 wherein at least one linkage element is flexible.

10. The boot defined by claim 5 wherein at least one of said two portions is journalled on the rigid shell base and wherein said latching means comprises means for latching and closure of the two portions of the upper relative to one another.

11. The boot defined by claim 5 wherein one of said two portions comprises a front portion of the upper comprising a flexional cuff, and the other of the portions comprises a rear portion comprising gear spoiler, wherein the rear spoiler is journalled on the shall base at substantially the level of the ankle of the skier, wherein said latching means comprises means for latching and closure of the rear spoiler on the cuff, wherein said at least one linkage element comprises a cable having two ends each of which are connected to opposite side of the cuff at an attachment point, wherein said boot comprises two guide elements, wherein said cable forms a flexible buckle having two ends, each of which wind at least partially on one guide element, wherein said guide elements are positioned on opposite sides of said spoiler and at one end of the rear spoiler, wherein said buckle is connected to said traction element, wherein said traction element is journalled on the rear spoiler, and said elastic apparatus is mounted between the rear spoiler and the traction element.

12. The boot defined by claim 5 wherein one of said two portions of said upper comprise a front portion comprising a cuff journalled on said shell base and adapted to undergo forward flexion around an axis substantially at the level of the ankle, wherein the other of said two portions of the upper comprises a rear portion comprising a spoiler which is journalled on the cuff, wherein said latching means comprises means for latching and closure of the rear spoiler on the cuff, wherein the at least one linkage element comprises a cable having two ends each of which are connected to opposite sides of the cuff at an attachment point, wherein said boot further comprises two guide elements, wherein the cable forms a flexible buckle having two ends each of which wind at least partially on one of said guide elements, wherein said guide elements are positioned at each side of the rear spoiler, wherein said buckle is connected to said traction element, wherein said traction element is mounted on the rear spoiler, and is journalled on the rear spoiler, and wherein the elastic apparatus is mounted between the rear spoiler and the traction element.

13. The boot defined by claim 5 wherein said two portions of said upper comprise, respectively, a front portion and a rear portion, wherein said front portion comprises a flexional cuff journalled on said rigid shell base, wherein said rear portion comprises a rear spoiler journalled separately from the cuff on the shell base substantially at the level of the ankle, wherein said latching means comprises means for latching and closure of the rear spoiler on the cuff, wherein said at least one linkage means comprises a cable having two ends each of which are connected to opposite sides of the cuff at an attachment point wherein said boot further comprises two guide elements, wherein the cable forms a flexible buckle having two portions each of which wind at least partially on a different guide element, wherein said guide elements are positioned on each side of the rear spoiler, wherein the buckle is connected to said traction element, wherein the traction element is journalled on the rear spoiler, and wherein said elastic apparatus is mounted between the rear spoiler and the traction element.

14. The boot defined by claim 5 wherein a skier's foot is adapted to be secured in said boot, wherein said journalled portions of said upper is adapted to move between open and closed positions, wherein said boot further comprises means for receiving said foot when said journalled portion is in said closed positions, wherein said journalled portion is adapted to be substantially freely journalled with respect to the other portion of the upper from the closed to the open position when the traction element occupies a threshold position ahead of a dead point of a self-latching elbow system formed by the alignment of said guide element with said journal axis of the traction element and said attachment point.

15. The boot defined by claim 14 wherein during the displacement of the journalled portion from the open position to the closed position the traction element is displaced from a first position toward said dead point to an intermediate threshold position for which the journalled portion is in said closed position but in which said journalled portion is substantially freely pivotable with respect to said other portion of said upper, wherein said intermediate threshold position is ahead of the dead point of the self-latching elbow system formed by the alignment of the at least one guide element with the journal axis of the traction element and of the attachment point of the at least one flexible element on the traction element.

16. The boot defined by claim 14 wherein said journalled portion is adapted to move from said closed position to a self-latching closed position on said other portion and the leg of the skier, wherein, in said self-latching closed position, traction element occupies a position which is bent back against the rear spoiler and said attachment point is ahead of said dead point of said self-latching elbow system.

17. The boot defined by claim 14 further comprising identification means provided between said traction means and said journalled portion for identifying said threshold position.

18. The boot defined by claim 14 wherein said traction element further comprises a cap having a depression thereon, and wherein said journalled portion comprises a projection adapted to engage said depression, wherein said depression and projection together comprises a ratchet for releasably holding said traction element at said threshold position.

19. The boot defined by claim 14 wherein said elastic apparatus comprises means for automatically pivoting said traction element to a self-latching closed position against said said journalled element in response to displacement of said traction element beyond said threshold position, thereby displacing said journalled portion to a selflatching position latched to said other portion of said upper.

20. The boot defined by claim 5 wherein a skier's foot is adapted to be secured in said boot, wherein said journalled portion of said upper is adapted to move between open and closed positions, wherein said boot further comprises means for immobilizing said journalled portion in the open position towards the rear wherein said boot further comprises means for permitting insertion of said foot when said journalled portion is in the open position, the traction element occupies a position in which said traction element extends away from the journalled portion when the journalled portion is in the open position, and wherein said traction element comprises means for freeing a length of said at least one linkage element which is equal to the amplitude of bending of the journalled portion of the upper.

21. The boot defined by claim 20 wherein said other portions of said upper is adapted to pivot forward, said boot further comprising means for neutralizing said immobilization means and automatically pivoting said journalled portion from said open position to said closed position in response to forward pivoting of said other portion of said upper.

22. The boot defined by claim 21 further comprising elastic means mounted between said two portions of said upper for biasing said journalled portion toward said other portion of said upper.

23. The boot defined by claim 22 wherein said journalled portion is adapted to be placed in a latched position latched to said other portion, wherein said automatic pivoting means further comprises means for pivoting said journalled portion into said latched position from said closed position.

24. The boot defined by claim 5 wherein said elastic apparatus is directly connected to said traction element, thereby permanently exerting a return moment directly on the traction element.

25. The boot defined by claim 5 wherein said boot further comprises an additional element, connected to said traction element, wherein said elastic apparatus exerts a permanent return force on said additional element so as to exert said return force indirectly on said traction element.

26. The boot defined by claim 5, wherein said elastic apparatus comprises at least one torsion spring having a plurality of spirals positioned coaxially with said journal axis.

27. The boot defined by claim 26, wherein said torsion spring comprises two arms of which one is supported on the traction element and the other on the journalled portion of said upper.

28. The boot defined by claim 27 wherein said arms of the spring are orthogonal with respect to one another.

29. The boot defined by claim 28, wherein one of the orthogonal arms is coaxial with said journal axis and the other arm is perpendicular to said journal axis and forms an angle $\alpha$ with a support surface on said journalled portion which is equal to the bending angle of the traction element as the traction element is displaced from a threshold position at which said at least one guide means, said attachment point, and said journal axis are aligned, to a self-latching closed position in which the longitudinal axis of said traction element is substantially parallel to the rear wall of said journalled portion.

30. The boot defined by claim 5 wherein said boot further comprises a connecting rod having two ends, wherein one end is journalled on said traction element, wherein said elastic apparatus comprises a spiral compression spring acting on the other end of said connecting rod.

31. The boot defined by claim 5 wherein one end of said traction element is journalled on said journalled portion, wherein said elastic apparatus comprises a compression spring acting directly on a flattened portion provided on the journalled end of said traction element.

32. The boot defined by claim 5, wherein the elastic apparatus comprises a torsion bar mounted at the same vertical level as said journal axis of the traction element on the journalled portion.

33. The boot defined by claim 5 further comprising a plurality of guide elements positioned in an upper zone of the journalled portion above said journal axis of the traction element.

34. The boot defined by claim 33, wherein the plurality of guide elements comprise elements bending said linkage element at an angle wherein each guide element comprises a grooved passage on said journalled portion.

35. The boot defined by claim 33 wherein said guide elements comprise rigid conduit guides integrated with the walls of the journalled portion.

36. The boot defined by claim 33, wherein the at least one linkage element passes through said plurality of guide elements on each side of the rear spoiler.

37. The boot defined by claim 5, wherein the traction element is journalled so to perform a rotation from the top to the bottom of the journalled portion as said journalled portion moves from an opened to a latched position latched to said other portion.

38. The boot defined by claim 5, wherein traction element is journalled so to perform a rotation from the bottom to the top of the journalled portion as said journalled portion moves from an opened to a latched position latched to said other portion.

39. The boot defined by claim 5 wherein the traction element comprises a journalled lever comprising adjustment means for adjusting the position of the point of attachment of the at least one linkage element.

40. The boot defined by claim 5, wherein the journal axis is positioned transversely to the longitudinal median axis of the boot and horizontally with respect to the plane of the sole of the boot.

41. The boot defined by claim 1 wherein said traction element comprises means for displacing at least one of said two portions of said upper rearwardly into an open position and then forwardly into a closed position against the leg of the skier in response to placing said foot in said boot.

42. A rear-entry type ski boot for holding the leg of a skier therein comprising:

(a) a rigid shell base;

(b) an upper comprising:

(i) a cuff (ii) a spoiler adapted to pivot between open and closed positions; and (c) means for automatically closing said spoiler, after said leg is inserted into said boot in response to pressure from said leg on said boot.

43. The boot defined by claim 42 wherein said closing means comprises:

(i) means for closing said spoiler in response to rearward pivoting of said spoiler.

44. The boot defined by claim 43 wherein said means for closing said spoiler in response to rearward pivoting of said spoiler comprises:

means for pivoting said spoiler into said open position from said closed position in response to insertion of said leg into said boot; and means for automatically pivoting said spoiler into said closed position from said open position in response to pivoting of said spoiler from said closed to said open position.

45. The boot defined by claim 44 wherein said spoiler is adapted to be latched on said cuff in a latched position wherein said boot further comprises:

(d) means for latching said spoiler on said cuff comprising:

(i) an element on said spoiler adapted to be displaced; and (ii) means for automatically pivoting said spoiler to said latched position from said closed position in response to displacement of said element.

46. The boot defined by claim 45 wherein said means for automatically pivoting said spoiler to said latched position comprises means for automatically pivoting said spoiler to said latched position from said closed position in response to displacement of said element by the finger of said skier.

47. The boot defined by claim 46 wherein said means for automatically pivoting said spoiler into said open and closed positions comprises:

(i) at least one flexible linkage element having first and second ends, wherein said first end is connected to one of said spoiler and cuff;

(ii) at least guide element mounted on said upper on which at least a portion of said linkage element is at least partially wound;

(iii) a traction element journalled on the other of said spoiler and cuff, wherein said traction element is connected to said second end of said linkage element; and (iv) an elastic apparatus biasing said traction element so that said traction element comprises means for permanently maintaining a traction force on said linkage element so as to constantly stretch said at least one linkage element between its two ends for all positions of said spoiler with respect to said cuff.

48. The boot defined by claim 47 wherein said traction element is journalled on an axis, wherein said latching means comprises said linkage element, said guide means, said traction element and said elastic apparatus, wherein the alignment of said journal axis, the point of connection between said second end and said traction element, and said guide element defines a threshold position for said traction element, wherein said spoiler automatically pivots to said latched position from said closed position in response to positioning said traction element ahead of said threshold position.

49. The boot defined by claim 42 wherein said cuff is adapted to flex forward, wherein said closing means comprises means for closing said spoiler in response to forward flexion of said cuff.

50. The boot defined by claim 49 further comprising:

elastic means for biasing said spoiler toward said cuff; and means for retaining said spoiler in said open position and for releasing said spoiler from retention in the open position in response to forward flexion of said cuff.

51. The boot defined by claim 50 wherein said closing means further comprises:

at least one flexible linkage element having first and second ends, wherein the first end is connected to one of the spoiler and the cuff;

at least one guide element mounted on the upper on which at least a portion of the linkage element is at least partially wound;

a traction element journalled on the other of the spoiler and cuff wherein the traction element is connected to the second end of the linkage element; and an elastic apparatus biasing the traction element so that the traction element comprises means for maintaining a traction force on the at least one linkage element so as to constantly stretch the linkage element for all positions of the spoiler with respect to the cuff.

* * * * *